US005924132A

United States Patent [19]

Wigutow

[11] Patent Number: 5,924,132

[45] Date of Patent: Jul. 20, 1999

[54] PORTABLE SHELTER/GARMENT

[76] Inventor: Jerald N. Wigutow, P.O. Box 2124, Grand Junction, Colo. 81502

[21] Appl. No.: 08/966,731

[22] Filed: Nov. 10, 1997

[51] Int. Cl.[6] ..... A41B 1/12; A41D 1/12; A41D 3/08

[52] U.S. Cl. ..... 2/69; 2/69.5; 2/89

[58] Field of Search ..... 2/69, 69.5, 88, 2/89; 224/154; 135/95, 87, 90, 96, 900

[56] References Cited

U.S. PATENT DOCUMENTS

| | | |
|---|---|---|
| 535,066 | 3/1895 | Mautner . |
| 573,918 | 12/1896 | Rice . |
| 578,691 | 3/1897 | Conant . |
| 608,351 | 8/1898 | Terramorse . |
| 646,421 | 1/1900 | Fisher . |
| 672,731 | 1/1901 | Conley . |
| 703,245 | 6/1902 | Faulkner . |
| 719,899 | 2/1903 | Stacey . |
| 766,719 | 8/1904 | Mason . |
| 901,802 | 10/1908 | Gotsche . |
| 1,138,229 | 5/1915 | Knoblauch . |
| 1,155,800 | 10/1915 | Corbet . |
| 1,193,443 | 8/1916 | Swan . |
| 1,215,139 | 2/1917 | Gail . |
| 1,252,628 | 1/1918 | Terry . |
| 1,346,320 | 7/1920 | Law . |
| 1,496,283 | 6/1924 | Wright . |
| 1,895,911 | 1/1933 | Bosson . |
| 2,093,889 | 9/1937 | Horn . |
| 2,268,317 | 12/1941 | Till . |
| 3,590,864 | 7/1971 | Vechesloff . |
| 4,180,867 | 1/1980 | Ridgeway . |
| 4,484,362 | 11/1984 | Asher . |
| 4,594,735 | 6/1986 | Rolf et al. . |
| 4,598,725 | 7/1986 | Brewer . |
| 4,703,521 | 11/1987 | Asher et al. . |
| 5,217,034 | 6/1993 | Yih et al. . |
| 5,257,427 | 11/1993 | Hinshaw . |
| 5,769,106 | 6/1998 | Achuff . |

*Primary Examiner*—John J. Calvert
*Assistant Examiner*—Shirra L. Jenkins
*Attorney, Agent, or Firm*—Clifton Ted Hunt

[57] ABSTRACT

Soldiers frequently form a make-shift shelter from a conventional poncho and the make-shift shelter is commonly called a "hootch" by soldiers. The term "hootch" is used here to refer to the portable shelter/garment, including its stuff sack, of this invention. The shelter/garment is made from pliable and waterproof fabric and is provided with snaps and loops along its edges and along its center line. The snaps and loops are used to hold the fabric in position after it has been folded to define a garment such as a poncho or a malke-shift shelter such as an A-frame. The snaps are arranged in such a way that two portable shelter/garments can be joined together to form a tent to shelter two persons. The portable shelter/garment of this invention was developed for use by the military and by hunters and others in need of a portable shelter while engaged in outdoor activities. The portable shelter/garment includes a storage pouch or stuff sack that is sewn to and extends from one edge of the portable shelter/garment to be readily available for storing and carrying the shelter/garment when it is not in use. The stuff sack, packed with its shelter/garment, can be mounted on a person's belt for portability.

6 Claims, 7 Drawing Sheets

PORTABLE SHELTER/GARMENT

FIELD OF THE INVENTION

This invention relates to a shelter/garment for an individual that can be folded or stuffed into an integrated pouch or sack and attached to a person's belt for portability between uses, and folded when needed to define a garment for the person to wear while active or a shelter to protect the person while inactive.

BACKGROUND OF THE INVENTION

It is known to provide garments that alternatively serve as shelters. See, for example, U.S. Pat. No. 4,484,362 issued Nov. 27, 1984 to Asher for MULTI-PURPOSE OUTERWEAR. Asher's garment/shelter comprises a rectangular sheet of pliable and waterproof material with an opening through the center to fit over a person's head, and a hood to cover the head. Zipper elements and snap fasteners extend along the longitudinal edges of the rectangular sheet and draw cords extend through sleeves along the shorter sides of Asher's sheet with snap fasteners or hook-and-loop closures on the outside of the sleeves for use in forming the sheet as a garment or shelter. Loops are provided on the longitudinal sides of the sheet to receive poles for the sheet to be used as a stretcher.

Asher provides no way of carrying his "multi-purpose outerwear" when it is not in use, but describes the disadvantages to campers and mountaineers of carrying separate equipment such as "sleeping shelter". Asher apparently contemplates that his "multi-purpose outerwear" will be worn as a poncho or other garment when not being used as a shelter. There are times, as in warm weather and certain military uses, when it is desirable to carry a shelter/garment instead of wearing it. Asher's "multi-purpose outerwear" can, of course, be packaged for carrying but the user would need a container that would be another piece of equipment to be carried, and maintained when not in use.

The present invention provides a shelter/garment with an integral sack or pouch to contain the shelter/garment for portability between uses, thereby obviating the need for a separate container for the shelter/garment between uses.

SUMMARY OF THE INVENTION

The portable shelter/garment of this invention was developed for use by the military and by hunters and others in need of a portable shelter while engaged in outdoor activities. The portable shelter/garment includes a storage pouch or stuff sack that is sewn to and extends from one edge of the portable shelter/garment to be readily available for storing and carrying the shelter/garment when it is not in use. The stuff sack, packed with its shelter/garment, can be mounted on a person's belt for portability.

The shelter/garment is made from pliable and waterproof fabric and is provided with snaps and loops along its edges and along its center line. The snaps and loops are used to hold the fabric in position after it has been folded to define a garment such as a poncho or a make-shift shelter such as an A-frame. The snaps are arranged in such a way that two portable shelter/garments can be joined together to form a tent to shelter two persons.

Soldiers frequently form a make-shift shelter from a conventional poncho and the make-shift shelter is commonly called a "hootch" by soldiers. The term "hootch" is used here to refer to the portable shelter/garment, including its stuff sack.

BRIEF DESCRIPTION OF THE DRAWINGS

10

DETAILED DESCRIPTION OF A PREFERRED EMBODIMENT OF THE INVENTION

Structure

Figure 1:
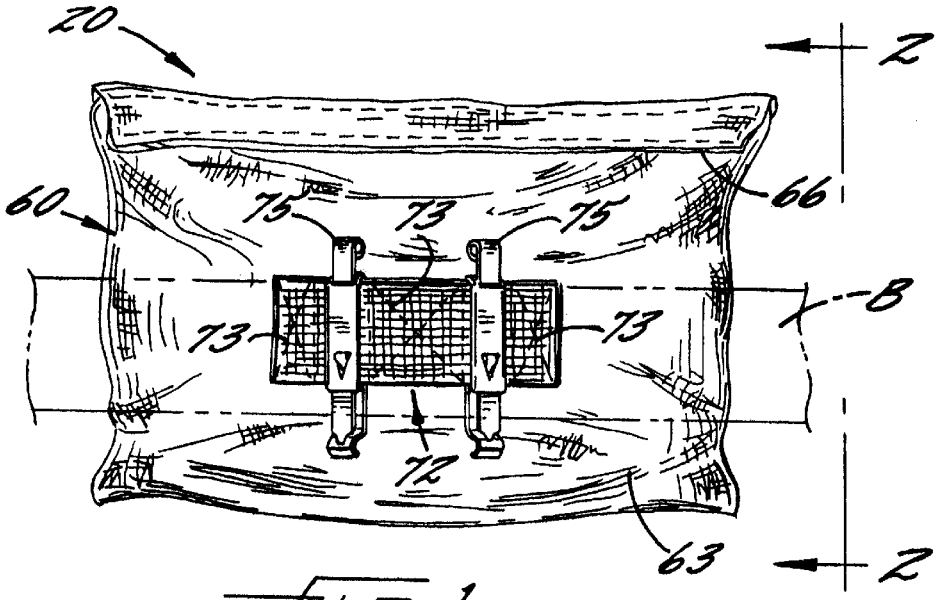
FIG. 1 is a rear view of a hootch after it has been packed in its stuff sack and attached to a belt for portability, with parts of the belt broken away and the belt being shown in phantom lines to indicate that it is not part of the invention.

Referring more specifically to the drawings, a hootch 20, having an outer surface 20A and an inner surface 20B, is formed from a pliable fabric such as waterproof single ply nylon taffeta. The fabric is conventionally delivered from the manufacturer in widths of sixty inches (1,542 mm). The fabric for each hootch is cut to define a center panel 21 and two side panels 22 and 23. In the illustrated embodiment, the center panel 21 is one foot three inches (381 mm) wide and nine feet (2,743.21 mm) long. Each of the side panels 22 and 23 is two feet four inches (711.2 mm) wide and nine feet (2,743.21 mm) long.

Figure 4:
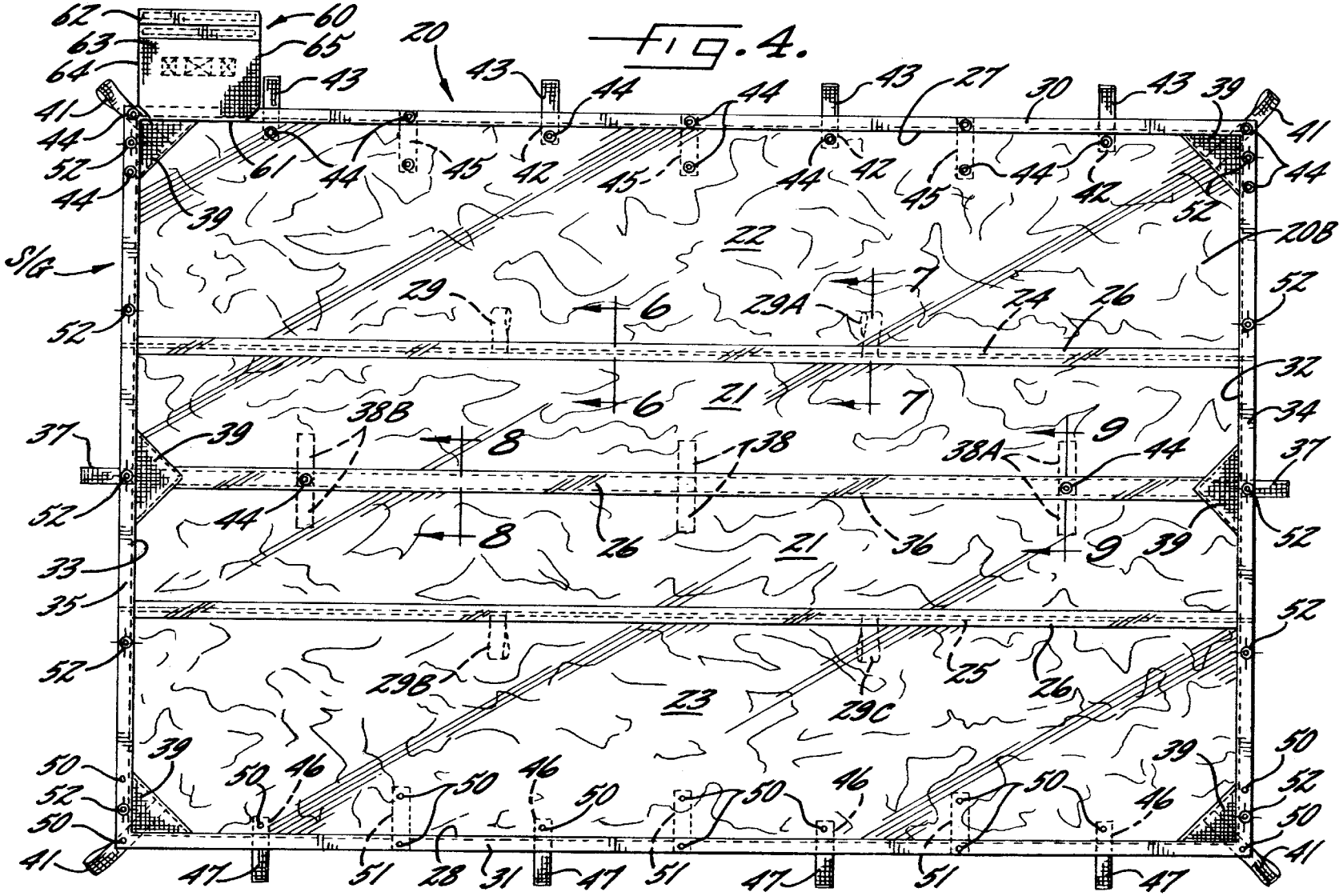
FIG. 4 is an inverted plan view looking at the inner surface of the shelter/garment.

Side panel 22 is sewn to center panel 21 with two rows of stitches, indicated at 24, and side panel 23 is sewn to center panel 21 with two rows of stitches, indicated at 25. The seams connecting the side panels 22 and 23 to the center panel 21 are seam taped as at 26 for waterproofing (FIG. 4). Longitudinal edges 27 and 28 of the hootch 20 are turned inwardly and seamed to form hems 30 and 31 and transverse edges 32 and 33 of the hootch are turned inwardly and seamed to form hems 34 and 35.

The stitches 24 connect loops 29 and 29A to the shelter/garment at points spaced about a third of the distance between the hems 34 and 35. Similarly, loops 29B and 29C are connected at the juncture of panels 21 and 23 in opposed relation to the loops 29 and 29A by the stitches 25.

The combined center panel 21 and side panels 22, 23 form a shelter/garment S/G.

Figure 5:
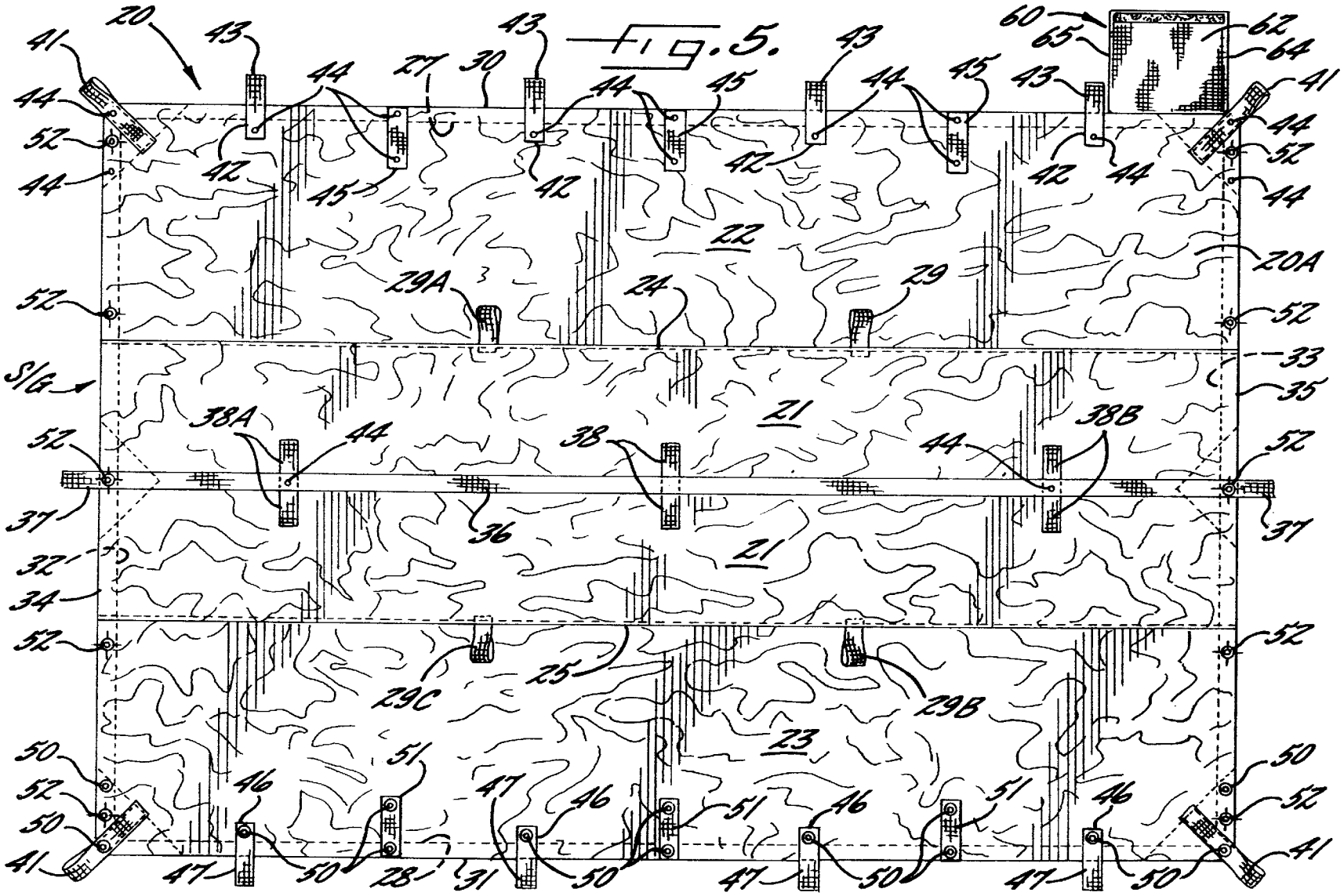
FIG. 5 is a plan view looking at the outer surface of the shelter/garment.
Figure 6:
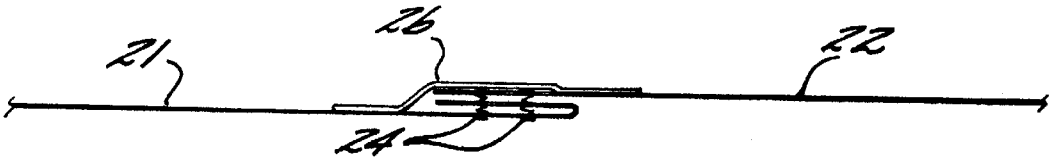
FIG. 6 is an enlarged sectional view taken substantially along the line 6—6 in FIG. 4.
Figure 7:
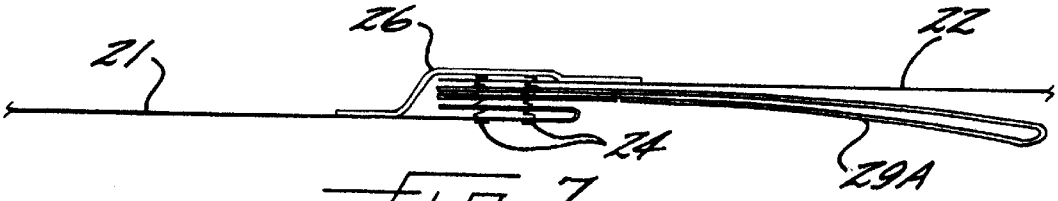
FIG. 7 is an enlarged sectional view taken substantially along the line 7—7 in FIG. 4.
Figure 8:
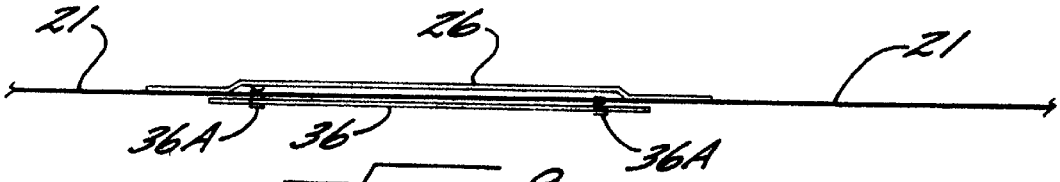
FIG. 8 is an enlarged sectional view taken substantially along the line 8—8 in FIG. 4.
Figure 9:
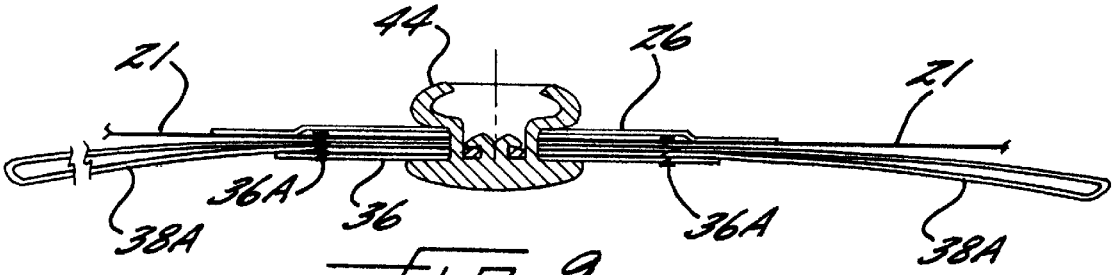
FIG. 9 is an enlarged sectional view taken substantially along the line 9—9 in FIG. 4.

Referring to FIG. 5, a strip of webbing 36 is seamed as at 36A (FIG. 8) along its longitudinal edges to the outer surface 20A of the center panel 21. As seen in FIG. 4, the seams connecting the web strip 36 to the center panel 21, are also seam taped as at 26 for waterproofing. The webbing 36 extends along the longitudinal center line of the central panel 21, terminating in loops 37 extending outwardly from the transverse hems 34 and 35. A double loop 38 extends from both sides of the web strip 36 at the center of central panel 21, and double loops 38A and 38B extend from both sides of the web strip at equally spaced points between the centrally disposed loop 38 and the hems 34 and 35 at the ends of panel 21.

Web gussets 39 are sewn to the inner surface 20B at the comers of the shelter/garment S/G and at each end of the web strip 36 extending along the center of the center panel 21. The gussets provide strength at these points, which are subject to the greatest stress when the hootch is in use.

Loops 41 extend diagonally from the gussets 39 at the corners of the shelter/garment S/G. Four transversely extending strips of webbing 42 are spaced equally from each other along the longitudinal hem 30 of side panel 22 and are sewn to its outer surface 20A. The web strips 42 extend inwardly and outwardly from the hem 30, terminating beyond the hem 30 in loops 43.

Female snap fasteners 44 extend through the web strips 42 at points equally spaced inwardly from the hem 30. Additional female snap fasteners 44 are provided on three web strips 45 extending inwardly from the hem 30, there being three fasteners 44 that extend through both the hem 30 and a web strip 45 and three more fasteners 44 extending through the inner end portions of the three web strips 45. Female snap fasteners 44 are also at each comer of the side panel 22, and two female snap fasteners extend through the seam tape 26 on the longitudinal center of the center panel 21. There is also a female snap fastener at each end of the side panel 22. The operative ends of all of the female snap fasteners 44 are on the inner surface 20B of the shelter/garment S/G (on the inner surface 20B of the side panel 22 and of the center panel 21).

Four transversely extending strips of webbing 46 are spaced equally from each other along the longitudinal hem 31 of side panel 23 and are sewn to its outer surface 20A. The web strips 46 extend inwardly and outwardly from the hem 31, terminating beyond the hem 31 in loops 47.

Male snap fasteners 50 extend through the web strips 46 at points equally spaced inwardly from the hem 31 on side panel 23. Additional male snap fasteners 50 are provided on three web strips 51 extending inwardly from the hem 31, there being three fasteners 50 that extend through both the hem 31 and a web strip 51 and three more fasteners 50 extending through the inner end portions of the three web strips 51. There are also male snap fasteners 50 at each corner of the side panel 23. The operative ends of all of the male snap fasteners 50 are on the outer surface 20A of the side panel 23.

There are two grommets 52 extending through each end of the side panels 22 and 23 and one grommet 52 extending through each end of center panel 21, for the reception of supporting ropes.

Functions of the Hootch

A. The Garment

Figure 10:
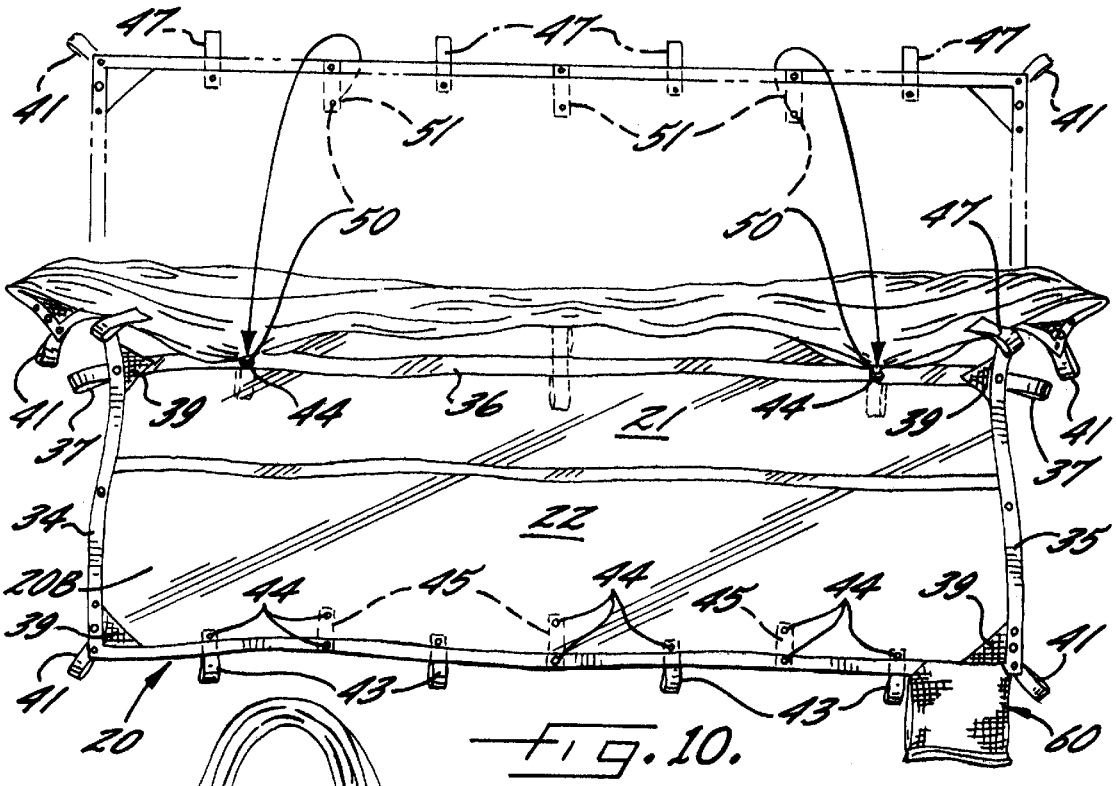
FIG. 10 is an inverted plan view similar to FIG. 4, showing one portion of the shelter/garment in phantom lines to indicate its initial position and showing that portion in solid lines after it has been folded inwardly to form a poncho by the connection of fasteners on the edge of the one portion with fasteners spaced from each other on the center line of the shelter/garment.
Figure 11:
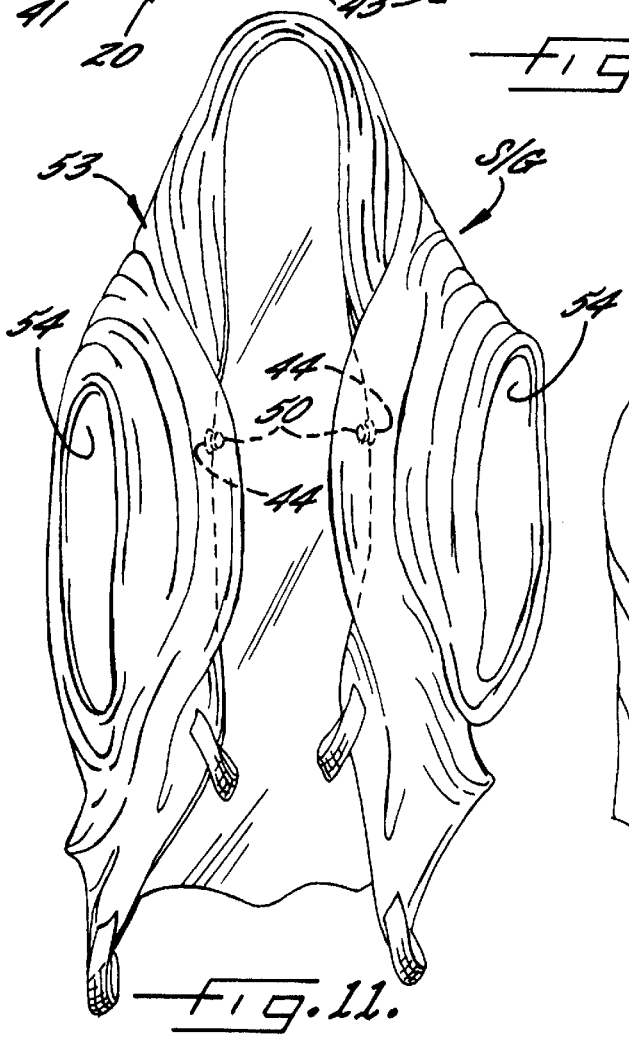
FIG. 11 is a front view of the poncho formed from the shelter/garment.
Figure 12:
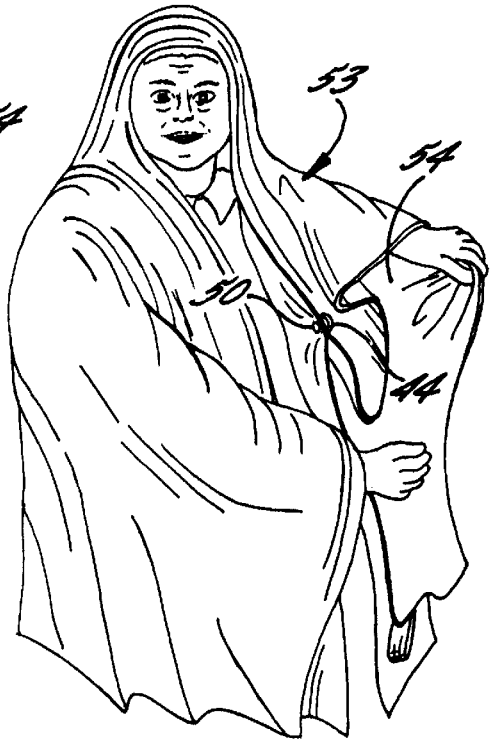
FIG. 12 is a front view of the poncho shown in FIG. 11 being worn by a person holding one side of the poncho open to illustrate the making of an arm hole by the connection of fasteners as illustrated in FIG. 10.

The hootch 20 can be used as a garment by folding and fastening it with selected male and female snap fasteners in the shape of a poncho. FIG. 10 illustrates the forming of a poncho 53 by folding in the hem 31 on side panel 23 to the web strip 26 at the center of panel 21 and connecting any two of the male snap fasteners on the panel 23 to the two female snap fasteners on the web strip 26 to define arm holes indicated at 54 in FIG. 11.

B. The Shelter

The shelter/garment S/G is easily made into a make-shift shelter, such as an A-frame 55 (FIG. 13) by passing ropes R extending from a supporting structure such as a tree (not shown) through the loops 38 at the center of panel 21 and through selected loops and/or grommets, such as the loops 29 and 29B and the grommets 52 at one end of the shelter/garment, for example. The loops 43 and 47 on the side panels 22 and 23 are used to anchor the shelter to the ground.

One advantage of the invention is that little or no training is required to form the hootch into a satisfactory garment or shelter because either can be formed in an infinite number of ways, depending on the selection of snap fasteners.

Figure 13:
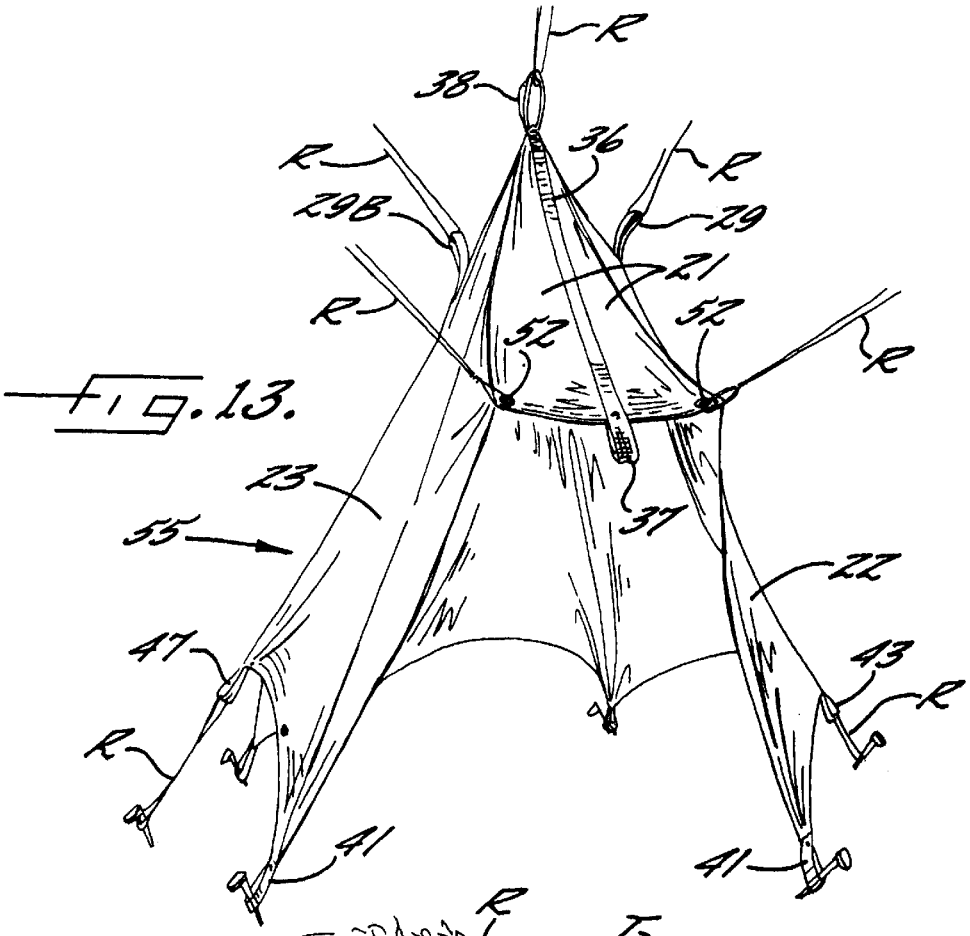
FIG. 13 is a perspective view of an A-frame made from a hootch by attaching ropes to loops sewn to the shelter/garment and suspending the hootch from a supporting structure, not shown.
Figure 14:
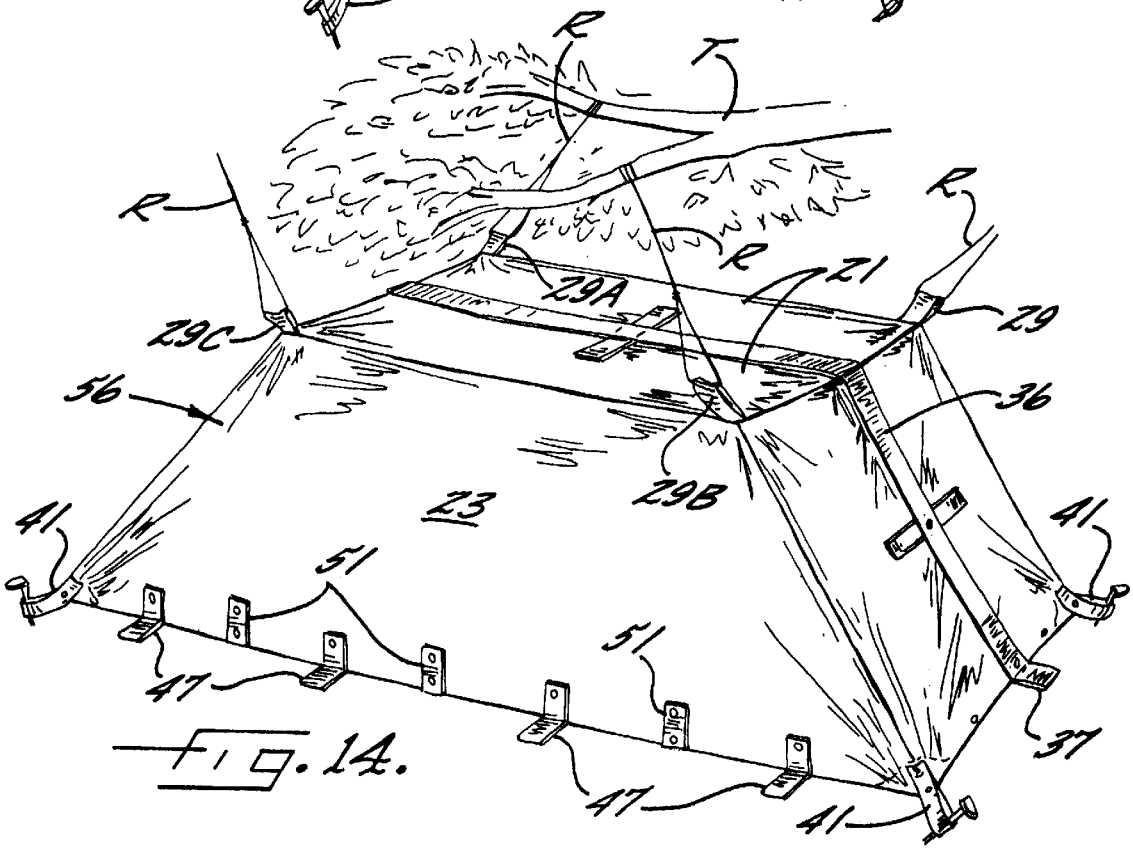
FIG. 14 is a perspective view of a tent made by attaching together two hootches and attaching ropes to loops sewn to the shelter/garment and suspending the interconnected hootches them from a supporting structure, such as tree branches.

The hootch can provide more shelter than the A-frame of FIG. 13 by forming a tent 56, an example of which is shown in FIG. 14. There, ropes R are passed through loops 29, 29A, 29B and 29C and attached to a tree T. The loops 41, 43 and 47 are used to anchor the shelter to the ground.

Figure 15:
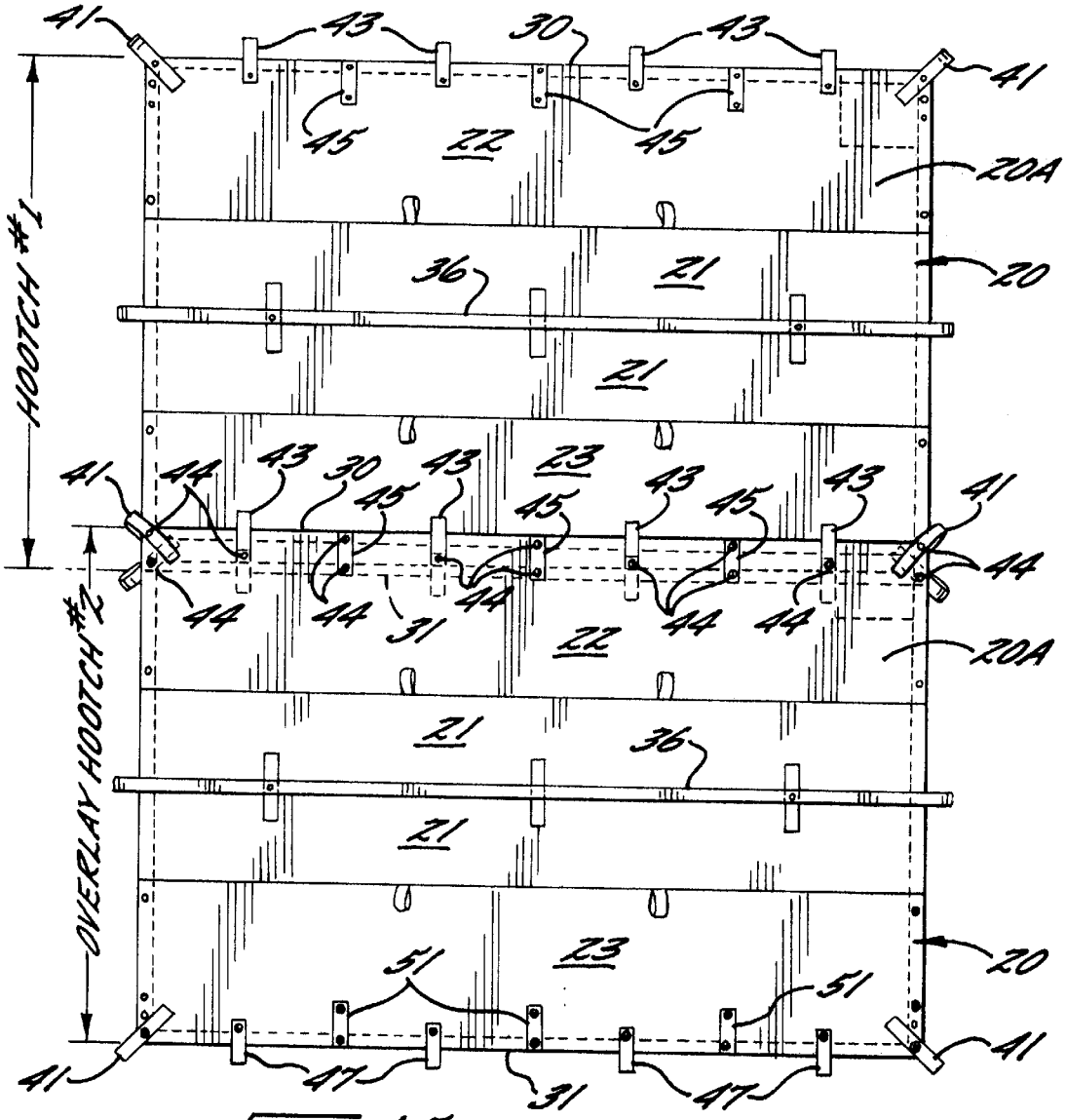
FIG. 15 is a plan view of two hootches connected together in partially overlapping relation to form the tent shown in FIG. 14.
Figure 16:
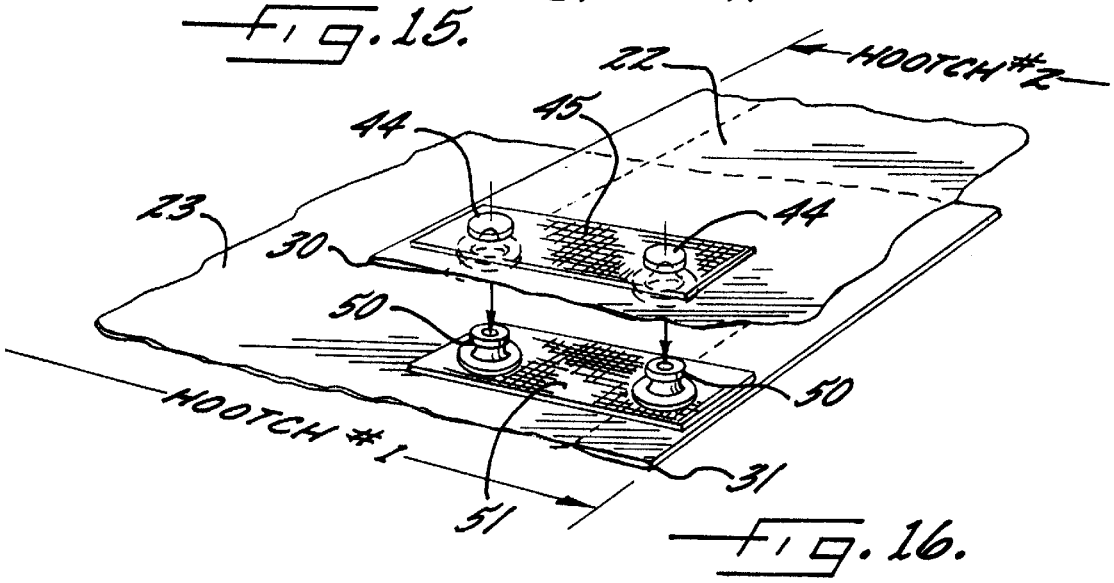
FIG. 16 is an exploded perspective view that is enlarged and with parts broken away, illustrating the connection of the two hootches shown in FIG. 15 with male and female snap fasteners.

Two hootches can be joined together to provide shelter for two persons by joining together the female snap fasteners on side panel 22 of one hootch with the male snap fasteners on side panel 23 of another hootch (FIGS. 15 and 16). The two hootches are then formed into a two-person tent in the manner shown by FIG. 14 for a one-person tent.

C. The Stuff Sack

A stuff sack or pouch 60, having an inner surface 60A and an outer surface 60B, is sewn as a permanent addition to the shelter/garment S/G. As shown in FIGS. 4 and 5 the inner surface 60A is exposed when the stuff sack is sewn to the shelter/garment. The closed end or bottom edge 61 of the inverted stuff sack 60 is sewn to the inner surface 20B of side panel 22 between the corner loop 41 and the proximal loop 43.

The stuff sack 60 is formed from a suitably durable fabric that is flexible and waterproof, having the inner surface 60A and an outer surface 60B. The fabric is sewn to define a front wall 62 and an opposing rear wall 63 extending from the closed end 61. The sides 64 and 65 of the front wall 62 and rear wall 63 are sewn together to define an open-top pouch, measuring 8.5 inches (215.9 mm)×10.5 inches (266.701 mm).

The front wall 62 of the stuff sack 60 extends beyond its rear wall 63 to define a closure flap 66. One element 70 of a transversely extending hook-and-loop fastener is fastened to the inner surface 60A of the closure flap 66. The other element 71 of the transversely extending hoolk-and-loop fastener is fastened to the outer surface 60B of the free end portion of the rear wall 63.

The stuff sack 60 is sewn to the shelter/garment S/G for the purpose of being readily available when it is desired to pack the shelter/garment for storage and mobility. The shelter/garment S/G can be folded to fit in the relatively small stuff sack, but that is not necessary. It can be, and preferably is, stuffed against the inner surface 60A of the sack 60 while inverting the stuff sack 60 to expose its outer surface 60B.

Figure 2:
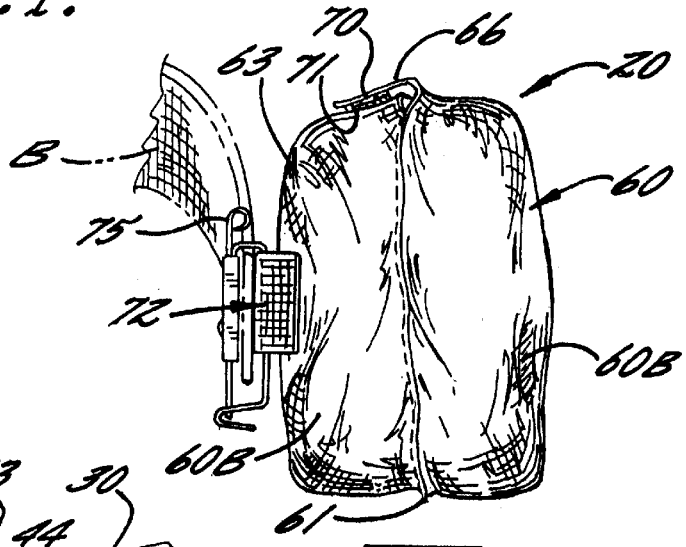
FIG. 2 is a sectional view taken substantially along the line 2—2 in FIG. 1.
Figure 3:
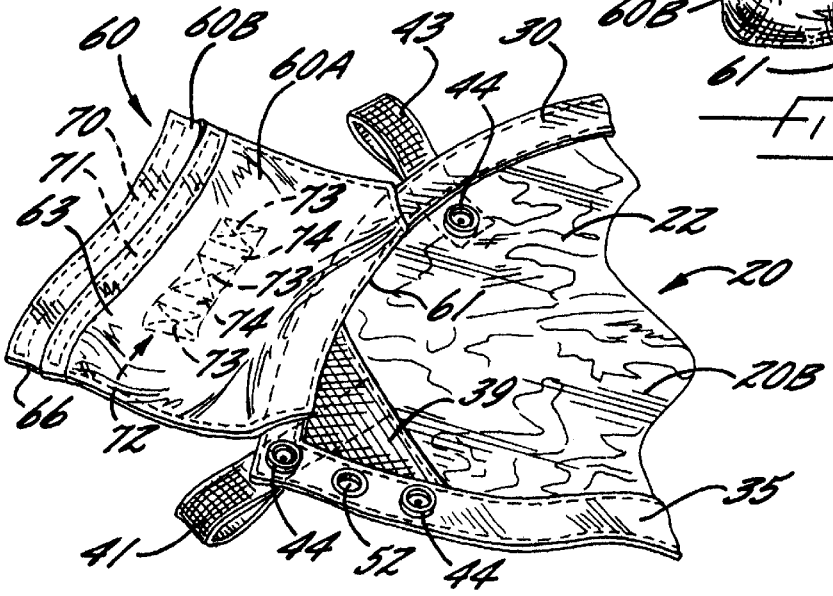
FIG. 3 is a perspective view, with parts broken away, of one corner of the hootch, illustrating the attachment of the stuff sack to the shelter/garment.

Inverting the stuff sack 60 by stuffing it with the shelter/garment S/G transforms the stuff sack 60 from the inoperative position of FIGS. 3, 4 and 5 to the operative position of FIGS. 1 and 2, and exposes a web strap 72 extending transversely on the outer surface 60B of the rear wall 63 of the stuff sack 60. The web strap 72 is sewn to the rear wall 63 with spaced areas of diagonal stitching 73 to define two open-ended pockets 74.

Each open-ended pocket 74 contains a clip 75, adapted to remain in their pockets 74, and including means for attachment to a person's belt B, as shown in FIGS. 1 and 2, for storage and portability of the hootch 20.

There is thus provided a unique and effective shelter/garment for a person's protection from the elements, including its own pouch for storage and portability. Although specific terms have been used in describing the invention, they have been used in a generic and descriptive sense only, and not for the purpose of limitation.

I claim:

1. A hootch for use by one person, the hootch comprising a shelter/garment formed from a sheet of waterproof flexible fabric, means for holding the fabric in a variety of folded positions to selectively define a garment or a shelter, said means comprising a plurality of female snap fasteners and a plurality of male snap fasteners, whereby selected male snap fasteners can be interlocked with selected female snap fasteners to define a garment or a shelter, second means comprising means for storing the shelter/garment when not in use, said second means being integrated with the sheet of fabric at the time of manufacture, said second means including third means comprising means for enhancing the portability of the shelter/garment, said third means comprising a clip attached to said second means, and said clip including fourth means comprising means for attaching the second means to a person's belt, whereby the shelter/garment can be placed in said second means and said clip be attached to the person's belt to enhance the portability of the shelter/garment.

2. A hootch for use by one person, the hootch comprising a shelter/garment formed from a sheet of waterproof flexible fabric including a first side panel, a center panel and a second side panel, means for holding the fabric in a variety of folded positions to selectively define a garment or a shelter, said means comprising a plurality of female snap fasteners wherein all said female snap fasteners are located on the first side panel and the center panel, and a plurality of male snap fasteners wherein all said male snap fasteners are located on the second side panel, whereby selected male snap fasteners can be interlocked with selected female snap fasteners to define a garment or a shelter.

3. The invention of claim 1 wherein all three panels include a plurality of loops and grommets for use in supporting and anchoring the shelter/garment when it is used as a shelter.

4. The invention of claim 3 which includes first and second hootches like the hootch of claim 2, and wherein female snap fasteners on the first side panel of the first hootch are registrable with male snap fasteners on the second side panel of the second hootch to form a tent for two persons.

5. The invention of claim 4 wherein the loops and grommets are used in the support and anchoring of the tent.

6. A hootch comprising a shelter/garment formed from a rectangular sheet of waterproof flexible fabric including a first side panel, a center panel and a second side panel, the first and second side panels having longitudinal edges extending in spaced parallel relation to the center panel, a plurality of female snap fasteners on the first side panel and the center panel, a plurality of male fasteners on the second side panel, a first group of female snap fasteners arranged in a pattern along the longitudinal edge of the first side panel, a second group of female snap fasteners arranged in a pattern on the center panel, a first group of male snap fasteners along the longitudinal edge of the second side panel and arranged in a pattern that corresponds to the pattern of the first group of female snap fasteners, whereby selected male fasteners can be fastened to selected female fasteners in said first group to form a shelter and selected male fasteners can be fastened to female fasteners on the center panel to form a garment, and a plurality of loops and grommets on each panel of the shelter/garment for use in the support and anchor of a shelter formed by the shelter/garment.

* * * * *